US011293244B2

(12) United States Patent
Mhaskar et al.

(10) Patent No.: US 11,293,244 B2
(45) Date of Patent: Apr. 5, 2022

(54) SLIP ASSEMBLY FOR A DOWNHOLE TOOL

(71) Applicant: Weatherford Technology Holdings, LLC, Houston, TX (US)

(72) Inventors: Nauman H. Mhaskar, Cypress, TX (US); Jorge Reyes Villegas, Houston, TX (US); James A. Rochen, Waller, TX (US); Jose L. Arredondo, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/805,297

(22) Filed: Feb. 28, 2020

(65) Prior Publication Data

US 2021/0270099 A1 Sep. 2, 2021

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01)

(58) Field of Classification Search
CPC ..... E21B 23/01; E21B 33/129
See application file for complete search history.

(56) References Cited

U.S. PATENT DOCUMENTS

| | | | |
|---|---|---|---|
| 7,048,055 | B2 | 5/2006 | Hirth |
| 9,273,527 | B2 | 3/2016 | Badrak |
| 9,470,060 | B2 | 10/2016 | Young et al. |
| 9,611,708 | B2 | 4/2017 | Rios, III |
| 9,643,250 | B2 | 5/2017 | Mazyar et al. |
| 9,759,035 | B2 | 9/2017 | Fripp et al. |
| 9,950,370 | B2 | 4/2018 | Roth-Fagaraseanu et al. |
| 9,969,003 | B2 | 5/2018 | Binder et al. |
| 10,011,044 | B2 | 7/2018 | Campomanes et al. |
| 10,081,853 | B2 | 9/2018 | Wilks et al. |
| 10,092,953 | B2 | 10/2018 | Mazyar et al. |
| 10,167,534 | B2 | 1/2019 | Fripp et al. |
| 10,265,770 | B2 | 4/2019 | Wilkinson |
| 2005/0173126 | A1 | 8/2005 | Starr et al. |
| 2007/0181224 | A1 | 8/2007 | Marya et al. |
| 2015/0368994 | A1* | 12/2015 | Mhaskar ..... E21B 23/01 166/217 |
| 2016/0024619 | A1 | 1/2016 | Wilks et al. |
| 2017/0130553 | A1* | 5/2017 | Harris ..... E21B 33/1208 |
| 2017/0218713 | A1 | 8/2017 | Walton et al. |
| 2017/0234103 | A1 | 8/2017 | Frazier |
| 2018/0238133 | A1 | 8/2018 | Fripp et al. |
| 2020/0040680 | A1 | 2/2020 | Mhaskar et al. |
| 2021/0025251 | A1* | 1/2021 | Xi ..... E21B 33/129 |

FOREIGN PATENT DOCUMENTS

WO 2019023493 A1 1/2019

* cited by examiner

*Primary Examiner* — Tara Schimpf
*Assistant Examiner* — Dany E Akakpo
(74) *Attorney, Agent, or Firm* — Patterson + Sheridan, LLP

(57) ABSTRACT

A downhole tool for engaging a downhole tubular includes a slip assembly. The slip assembly may include a slip body; a slip insert disposed in the slip body, the slip insert comprising a dissolvable metal alloy; and a plurality of gripping elements coupled to the slip insert, the gripping element configured to engage the downhole tubular.

20 Claims, 17 Drawing Sheets

SLIP ASSEMBLY FOR A DOWNHOLE TOOL

BACKGROUND

Field

Embodiments of the present disclosure generally relate to a slip assembly for a downhole tool.

Description of the Related Art

Slips are used for various downhole tools, such as bridge plugs and packers. The slips can have inserts or buttons to grip the inner wall of a casing or tubular. Inserts for slips are typically made from cast or forged metal, which is then machined and heat-treated to the proper engineering specifications according to conventional practices.

Inserts for slips on metallic and non-metallic tools (e.g., packers, plugs, etc.) must be able to engage with the casing to stop the tools from moving during its operation. On non-metallic tools, such as composite plugs, the inserts can cause the non-metallic slips to fail when increased loads are applied. Of course, when the slip fails, it disengages from the casing. On non-metallic tools, the inserts also need to be easily milled up to assist in the removal of the tools from the wellbore.

A downhole tool, such as a bridge plug or a packer, can include a slip and a cone disposed on a mandrel. In operation, the slip and the cone are moved toward one another to cause the slip to move away from the mandrel and engage against a surrounding tubular or casing. Either the slip is pushed against the ramped surface of the cone, the cone is pushed under the slip, or both.

One particular type of downhole tool having slips is a composite fracture plug used in perforation and fracture operations. During the operations, the composite plugs need to be drilled up in as short of a period of time as possible and with no drill up issues. Conventional composite plugs use metallic wicker style slips, which are composed of cast iron. These metallic slips increase the metallic content of the plug and can cause issues during drill up in horizontal wells.

Due to the drawbacks of cast iron slips, some composite slips use inserts made of carbide. When the downhole tool having slips with carbide inserts are milled out of the casing, the inserts tend to collect in the casing and are hard to float back to the surface. In fact, in horizontal wells, the carbide inserts may collect at the heel of the horizontal section and cause potential problems for operations. Given that a well may have upwards of forty or fifty bridge plugs used during operations that are later milled out, a considerable number of carbide inserts may be left in the casing and difficult to remove from downhole.

There is a need, therefore, for a downhole tool having a slip assembly that is at least partially dissolvable.

SUMMARY

In one embodiment, a downhole tool for engaging a downhole tubular includes a slip assembly. The slip assembly may include a slip body; a slip insert disposed in the slip body, the slip insert comprising a dissolvable metal alloy; and a plurality of gripping elements coupled to the slip insert, the gripping element configured to engage the downhole tubular.

In another embodiment, a downhole tool for engaging a downhole tubular includes a cone having an inclined surface and a slip assembly configured to ride along the inclined surface. The slip assembly may include an injection molded slip body; a slip insert disposed in the slip body, the slip insert comprising a dissolvable metal alloy; and a plurality of gripping elements coupled to the slip insert, the gripping element configured to engage the downhole tubular.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
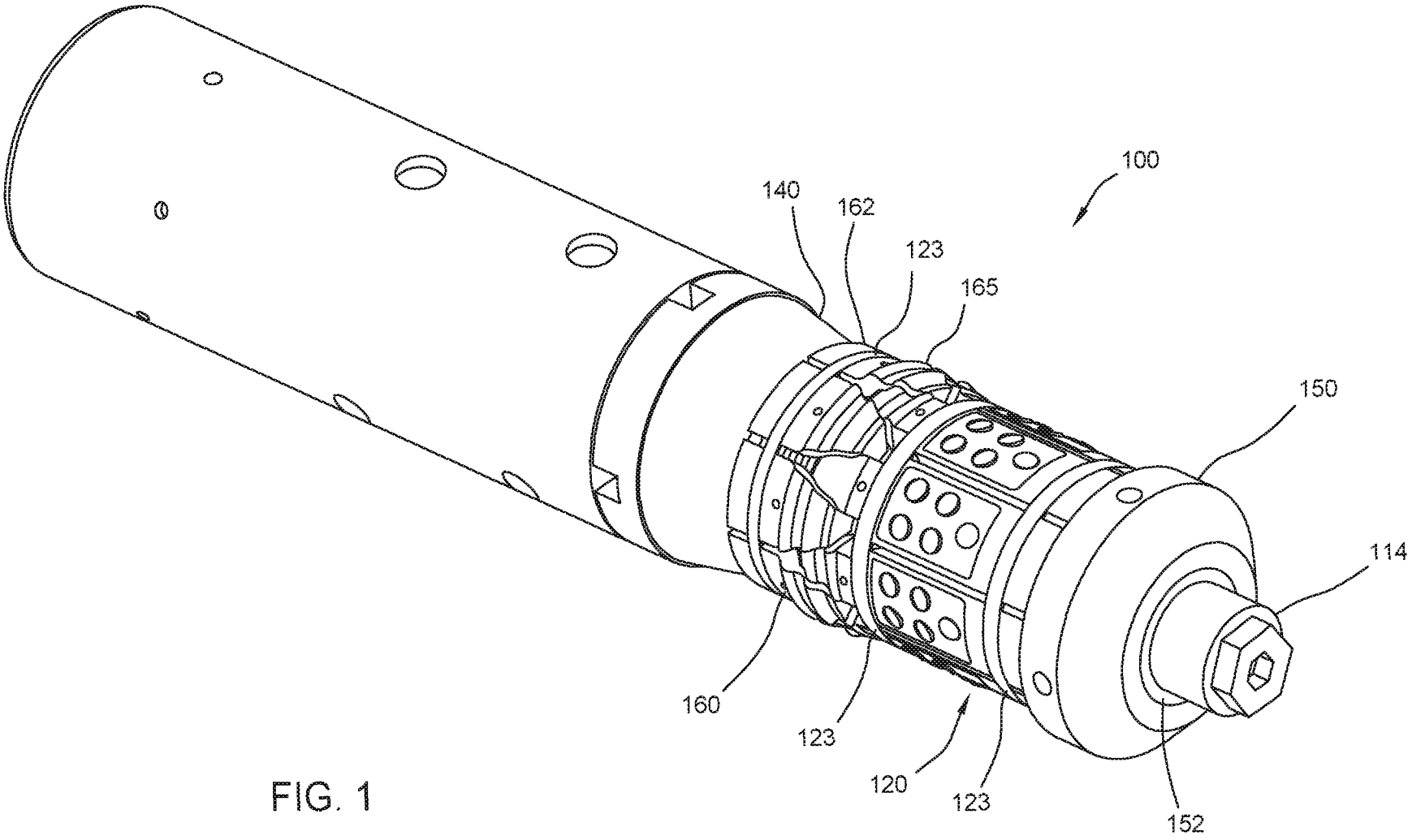
FIG. 1 is a perspective view of a downhole tool according to an embodiment of the present disclosure.
Figure 1A:
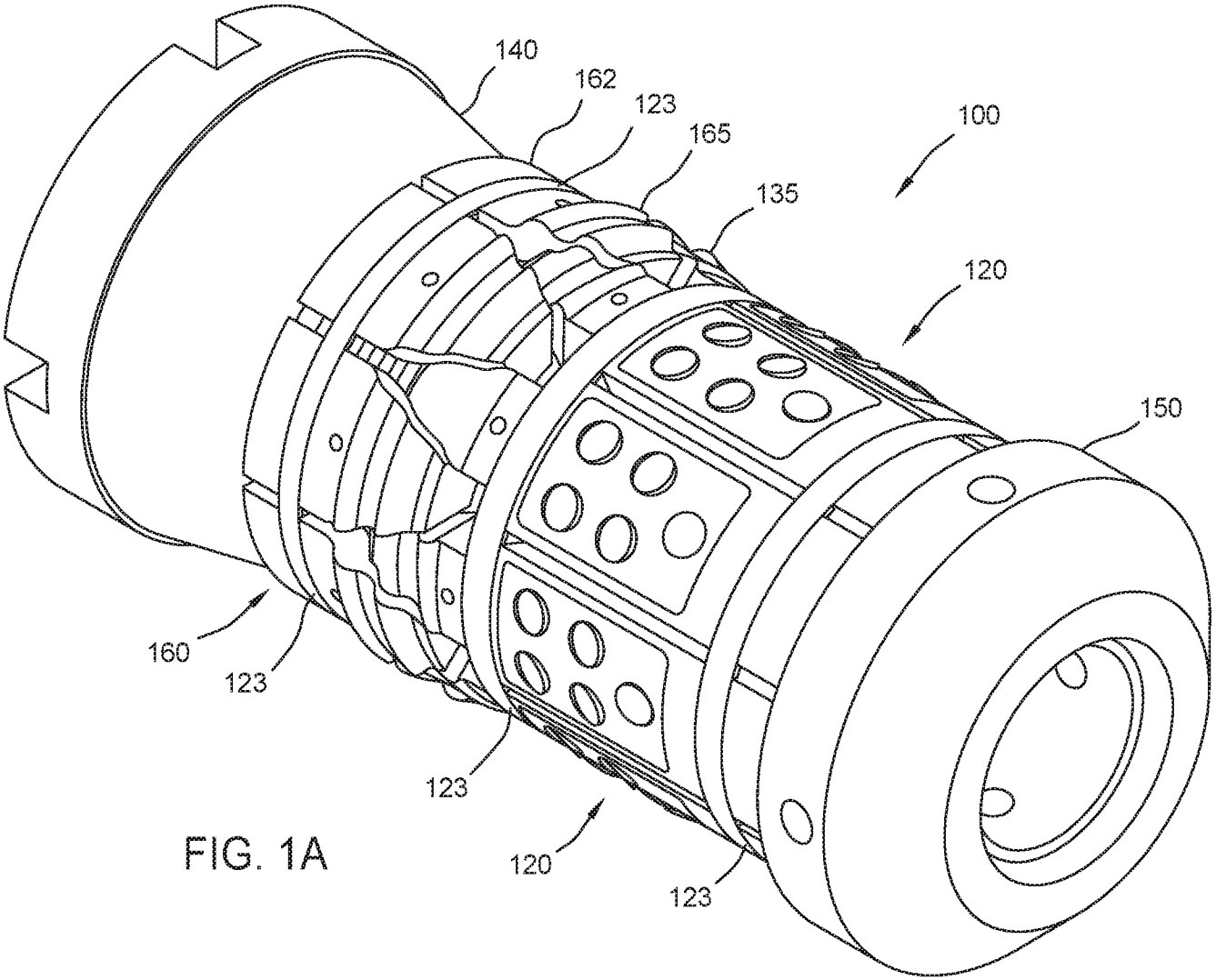
FIG. 1A is an enlarged perspective view of the downhole tool of FIG. 1.
Figure 2:
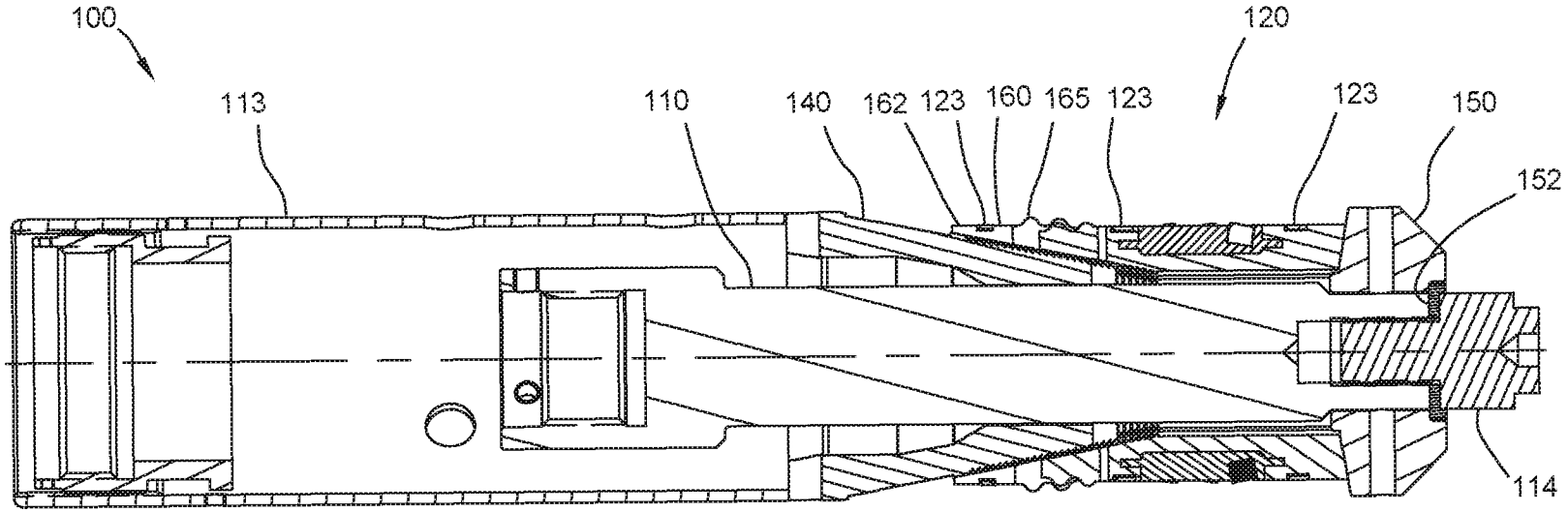
FIG. 2 is a cross-sectional view of the downhole tool of FIG. 1.
Figure 2A:
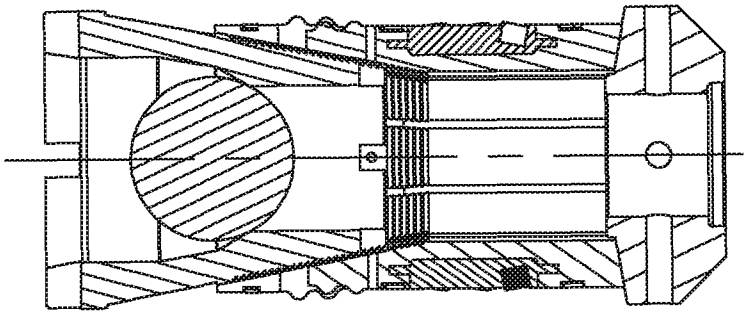

FIG. 1 is a perspective view of a downhole tool 100 according to an embodiment of the present disclosure. FIG. 1A is an enlarged perspective view of the downhole tool 100. FIG. 2 is a cross-sectional view of the downhole tool 100 of FIG. 1. The downhole tool 100 can be a bridge plug as shown, but it could also be a packer, a liner hanger, an anchoring device, or other downhole tool that uses a slip assembly to engage a downhole tubular, such as casing.

The tool 100 includes a cone 140, a slip assembly 120, a seal assembly 160, and an end ring 150 arranged on a mandrel 110. As shown, the slip assembly 120 is disposed between the cone 140 and the end ring 150. One end of the mandrel 110 is releasably attached to the end ring 150. For example, a shear ring 152 is used to releasably attach the mandrel 110 and the end ring 150. The shear ring 152 can be disposed between the mandrel 110 and a nut 114 coupled to the end of the mandrel 110. FIGS. 1 and 2 show the downhole tool 100 coupled to a setting sleeve 113 for activating the tool 100.

In one embodiment, one or more components of the tool 100 are preferably composed of degradable materials so the tool 100 can be removed from the casing upon completion of operations without requiring a milled out operation. For example, at least one of the cone 140, the end ring 150, the slip assembly 120, and the seal assembly 160 can be manufactured from a degradable material. In one example, one or more components of the tool 100 are composed of a dissolvable material. An exemplary dissolvable material is a dissolvable polymeric material.

Referring back to FIGS. 1 and 2, the cone 140 includes an inclined surface and is arranged on the mandrel 110 with its inclined surface facing the end ring 150. In this example, teeth are formed on the inclined surface for mating with the teeth of the sealing assembly 160 and the teeth of the slip assembly 120. In one embodiment, the cone 130 is made of a degradable polymer.

The slip assembly 120 is disposed between the cone 140 and the end ring 150. In one embodiment, the slip assembly 120 includes a plurality of slip segments 122 circumferentially disposed around the mandrel 110. In this example, the slip assembly 120 includes eight slip segments 122. However, any suitable number of slip segments 122 may be used. The plurality of slip segments 122 can be held together using one or more bands. In another embodiment, the slip assembly 120 is a unitary body.

Figure 3:
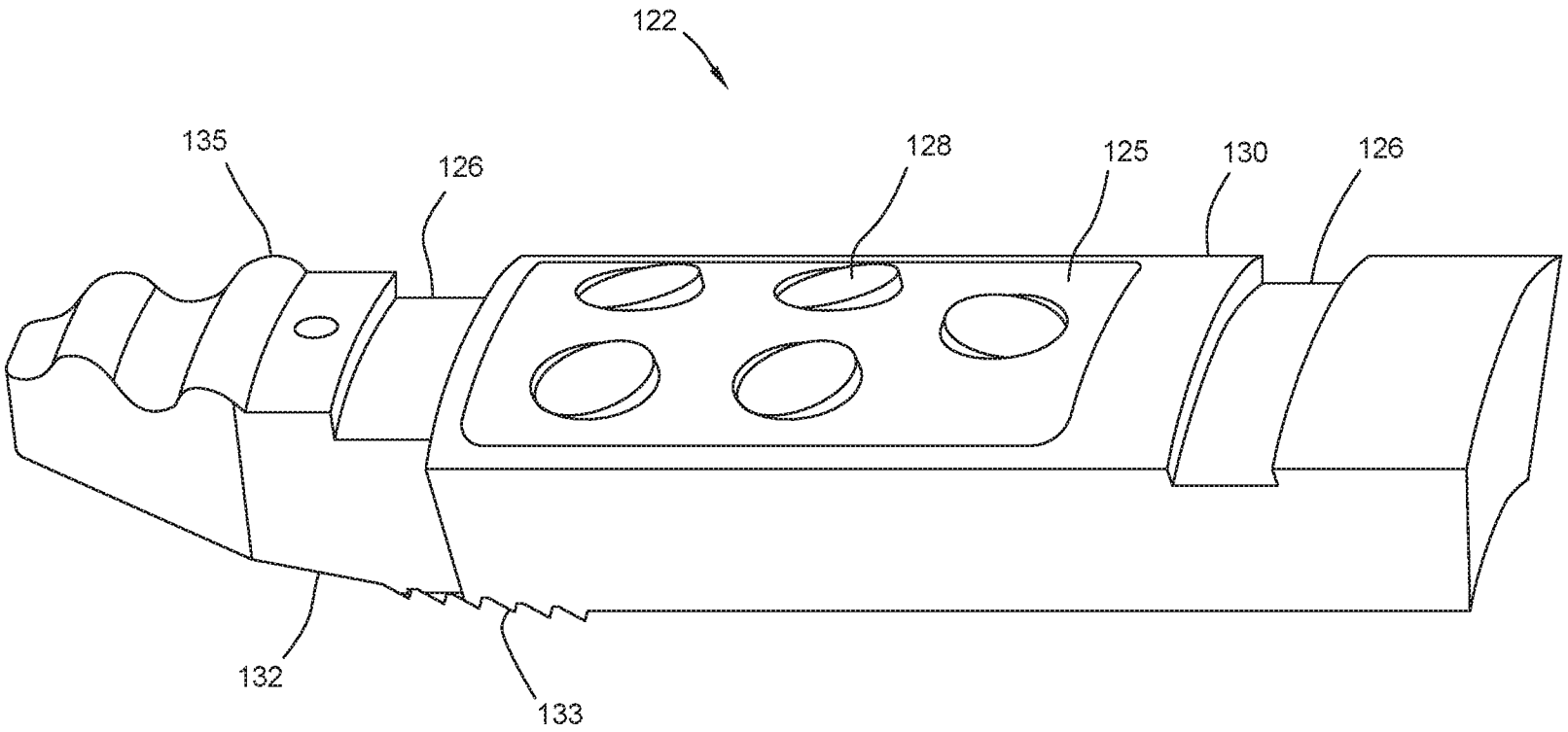
FIG. 3 is a perspective view of an exemplary embodiment of a slip segment.
Figure 4:
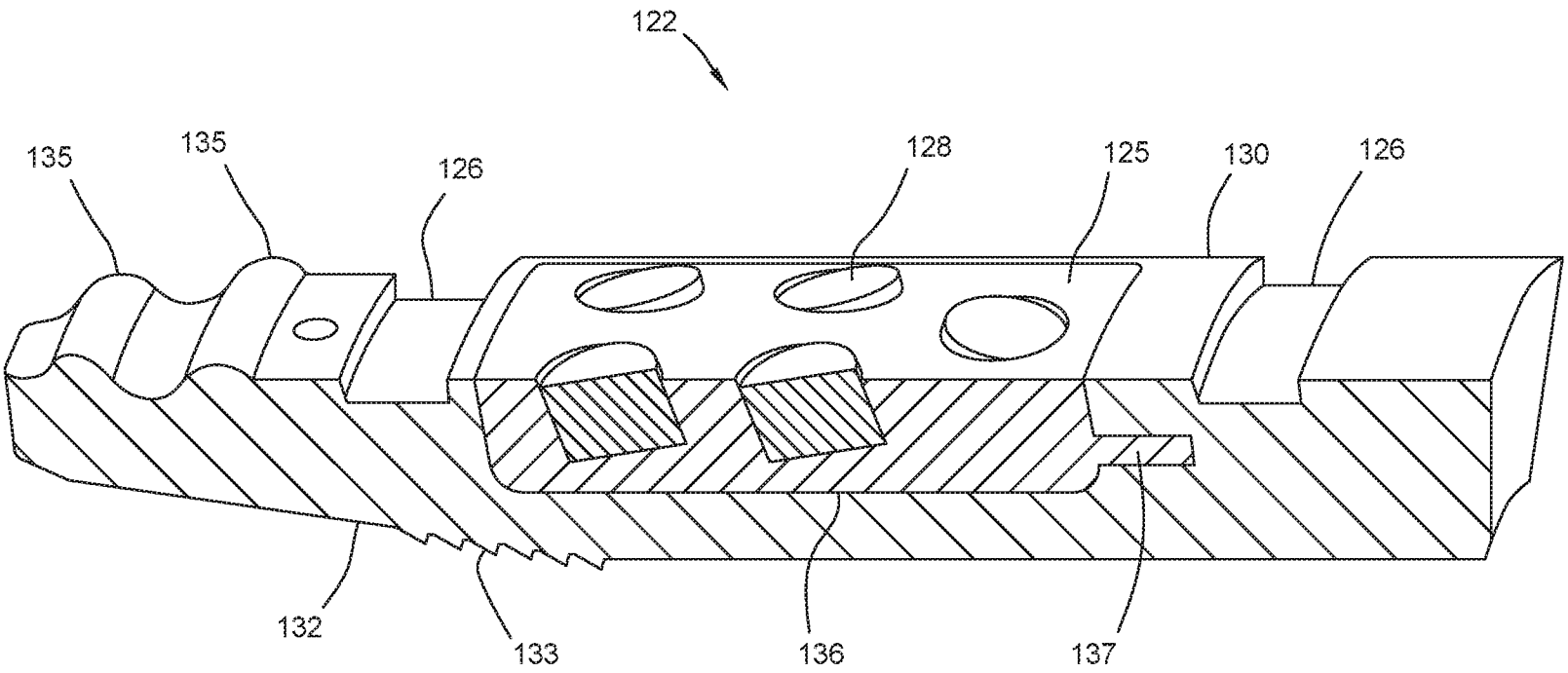
FIG. 4 is a cross-sectional view the slip segment of FIG. 3.

FIG. 3 is a perspective view of an exemplary embodiment of a slip segment 122. FIG. 4 is a cross-sectional view the slip segment 122 of FIG. 3. The slip segment 122 includes a slip body 130, a slip insert 125, and a gripping element such as a button 128. The slip body 130 has an inclined surface 132 for riding on the inclined surface of the cone 140. Teeth 133 may be provided on the inclined surface 132 for mating with the teeth of the cone 140. Grooves 126 for bands 123 may be provided in the outer surface of the slip body 130 for retaining the slip segments 122 to the downhole tool 100. In one embodiment, the bands 123 are expandable. The end of the slip body 130 with the inclined surface has a wedge shape. One or more sealing protrusions 135 having an arcuate shape are formed on the outer surface of the wedge shaped end of the slip body 130. The arcuate sealing protrusions 135 are configured to sealingly engage the casing wall when the slip segment 122 is urged outward by the cone 140. While two protrusions 135 are shown, any suitable number of protrusions may be provided, such as one, three, or more protrusions. During run-in, the slip segments 122 may be selectively attached to the cone 140 using a shearable connection, such as a shear pin, to prevent premature activation of the slip assembly 120.

In one embodiment, the slip body 130 is made of a dissolvable non-metallic material. Suitable dissolvable non-metallic materials include dissolvable non-metallic polylactic acid (PLA) based polymers, polyglycolic acid (PGA) based polymers, degradable urethane, other polymers that are dissolvable over time. In one example, the slip body 130 is manufactured using an injection molding process. The dissolvable non-metallic material is injected into a mold of the shape of the slip body 130, where it is allowed to solidify before removal from the mold. The injection molding process advantageously provides for a lower cost slip assembly manufacturing process and for various designs of the slip assembly such as segmented, interconnected, or unitary body. In one embodiment, the bands 123 may be made of a dissolvable non-metallic material or a dissolvable metallic alloy.

The slip insert 125 is disposed in a pocket 136 formed in the slip body 130. In one embodiment, the slip insert 125 is attached to the slip body 130 after the slip body 130 is removed from the injection mold. In another embodiment, the slip insert 125 is disposed in the mold before the slip body material is injected into the mold. In this respect, the slip insert 125 is attached to the slip body 130 as the slip body solidifies. In one example, the slip insert 125 includes one or more tongues 137 that are engageable with a slot formed in the slip body 130. The tongues 137 facilitate attachment of the slip insert 125 to the slip body. In another embodiment, the pocket 136 is a hole and the slip insert 125 extends through the depth of the slip body 130.*p*

In one embodiment, the slip insert 125 is made of a dissolvable metallic material. Suitable dissolvable metallic materials include magnesium or aluminum based dissolvable alloys. The dissolvable metallic materials are dissolvable upon contact with a solvent.

Each slip insert 125 includes one or more gripping elements for gripping the casing. An exemplary gripping element is a slip button 128. In this example, a plurality of slip buttons 128 are embedded into the slip insert 125. In at least one aspect, a portion of the slip buttons 128 is recessed into a corresponding cavity formed in the outer surface of the slip body 130. At least a portion of the slip buttons 128 extends from the outer surface of the slip insert 125. Each of the slip buttons 128 typically has one or more sharp edges that protrude from the outer surface of the slip body 130. However, the slip buttons 128 may take any form or shape. In one example, the buttons 128 have a cylindrical shape. The buttons 128 can be installed at an angle relative to the radius of the slip assembly 120 such that a portion of the upper surface extends out of the upper surface of the slip insert 125. The slip buttons 128 may be made of any material that will penetrate the casing. For example, the slip buttons 128 made be made of machined ductile iron, cast iron, powder metal, ceramic, or combinations thereof.

The slip insert 125 can include any number of buttons 128 having any suitable arrangements. As shown, five buttons 128 are disposed in the slip insert 125. In one example, the slip insert 125 can include one to twelve buttons 128 or two to eight buttons 128. The buttons 128 can be arranged in one or more rows and/or one or more columns in the top surface. For instance, two rows of buttons 128 may be used, each having the same number of columns. Alternatively, two rows can be used, but one row may have two columns while the other has one column. These and other suitable arrangements can be used as will be appreciated.

In one arrangement, the buttons 128 can be the same size and can be disposed in equivalent sized cavities in the slip insert 125. In another arrangement, the depth of the cavities can vary within a slip insert 125, between one or more segments 122, or both. Therefore, one or more buttons 128 can be longer than other buttons 128 and engage the casing before other buttons 128. It must be noted the description of the buttons in this embodiment or other embodiments is applicable to any of the embodiments described herein.

The seal assembly 160 is disposed on the cone 140 adjacent the slip assembly 120. In one embodiment, the seal assembly 160 includes a plurality of segments 162 circumferentially disposed around the mandrel 110. In this example, the seal assembly 160 includes eight seal segments 162. However, any suitable number of seal segments 162 may be used. The plurality of seal segments 162 can be held together using one or more bands. In another embodiment, the seal assembly 160 is a unitary cylindrical body.

Referring to FIGS. 1, 1A, and 2, the seal segment 162 includes an inclined surface for riding on the inclined surface of the cone 140. Teeth may be provided on the inclined surface for mating with the teeth of the cone 140. Grooves for bands 123 may be provided in the outer surface of the seal segment 162 for retaining the seal segments 162 to the downhole tool 100. The end of the seal segment 162 adjacent the slip segments 122 has a wedge shape. The wedge shape end is disposed between two adjacent wedge shaped ends of the slip segments 122. One or more sealing protrusions 165 having an arcuate shape are formed on the outer surface of the wedge shaped end of the seal segment 162. The arcuate sealing protrusions 165 are configured to sealingly engage the casing wall when the seal segment 162 is urged outward by the cone 140. While two protrusions 165 are shown, any suitable number of protrusions may be provided, such as one, three, or more protrusions. Upon expansion, the sealing protrusions 165 of the seal segments 162 are configured to form a seal ring with the sealing protrusions 135 of the slip segments 122. In this respect, the downhole tool 100 can be expanded to close fluid communication through the casing.

In one embodiment, the seal segment 160 is made of a dissolvable non-metallic material. Suitable dissolvable non-metallic materials include dissolvable non-metallic polylactic acid (PLA) based polymers, polyglycolic acid (PGA) based polymers, degradable urethane, other polymers that are dissolvable over time. In one example, the seal segment 160 is manufactured using an injection molding process. The dissolvable non-metallic material is injected into a mold of the shape of the seal segment 160, where it is allowed to solidify before removal from the mold. The injection molding process advantageously provides for a lower cost manufacturing process and for various designs of the seal assembly such as segmented, interconnected, or unitary body.

When deployed downhole, the tool 100 is activated by a wireline setting tool, which uses conventional techniques of pulling the mandrel 110 while simultaneously pulling the slip assembly 120 against the cone 140. The cone 140 is axially abutted against the setting sleeve 113. As a result, the slip assembly 120 ride up the cone 140 and move outward to engage a wall of the surrounding casing. In this manner, the slip assembly 120 retains the downhole tool 100 in place in the casing. The slip assembly 120 also causes the seal assembly 160 to move up the inclined surface of the cone 140.

Figure 5:
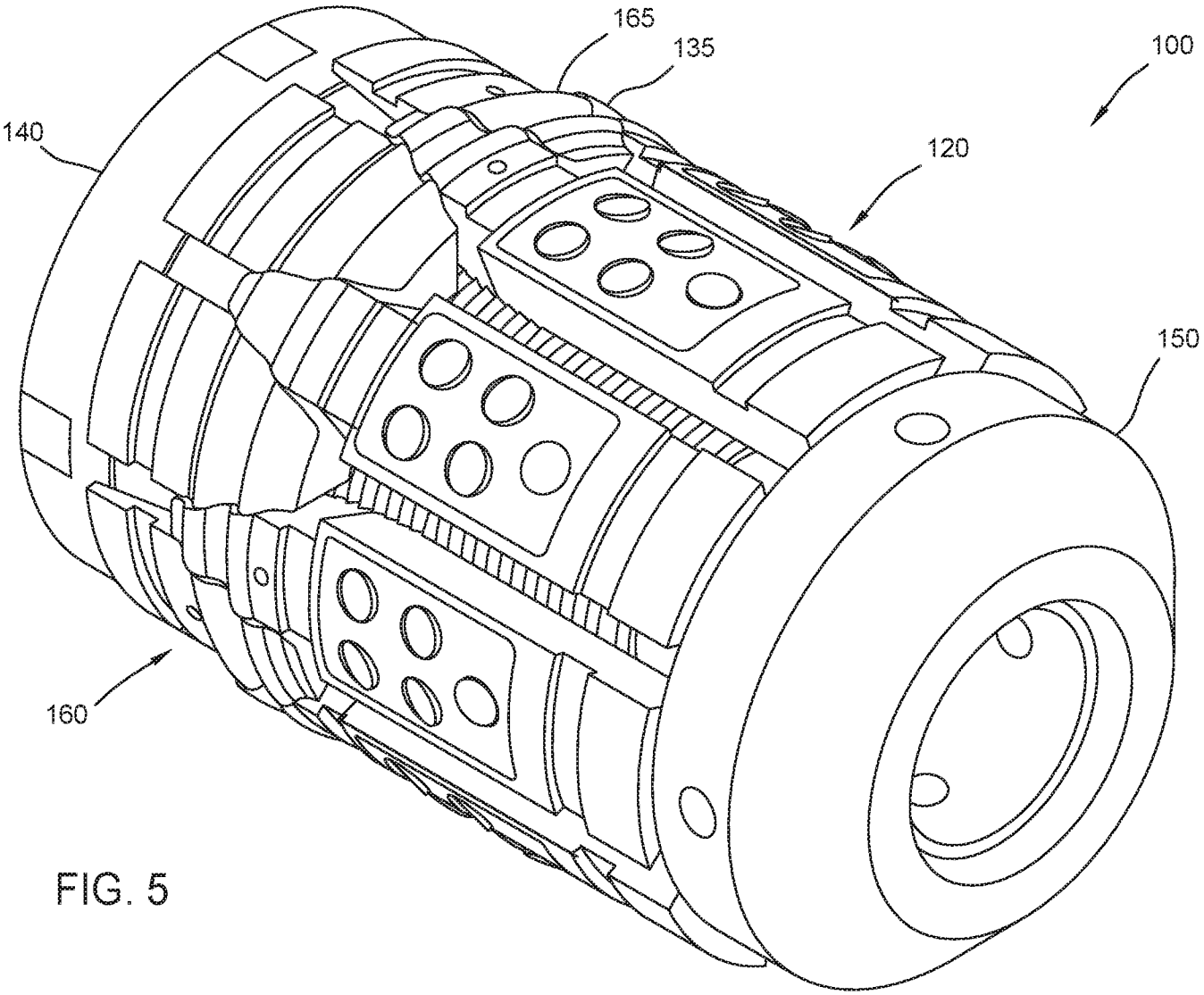
FIG. 5 shows the downhole tool of FIG. 1 after setting the slip assembly.

FIG. 5 shows the downhole tool 100 after setting the slip assembly 120. The slip segments 122 and the seal segments 162 have moved up the cone 140 and expanded radially. The seal protrusions 135 of the slip segments 122 are substantially aligned with the seal protrusions 165 of the seal segments 162 to form a seal ring against the casing. Thereafter, the setting sleeve 113 and the mandrel 110 can be retrieved to surface.

To begin the fracturing operation, a ball is released into the casing and lands in a seat of the downhole tool 100. Fracturing fluid is pumped into the casing to fracture the formation upstream from the downhole tool 100. After pumping the fracturing fluid, the downhole tool 100 may degrade over time, thereby eliminating the need for a drilling operation to remove the downhole tool 100.

Figure 6:
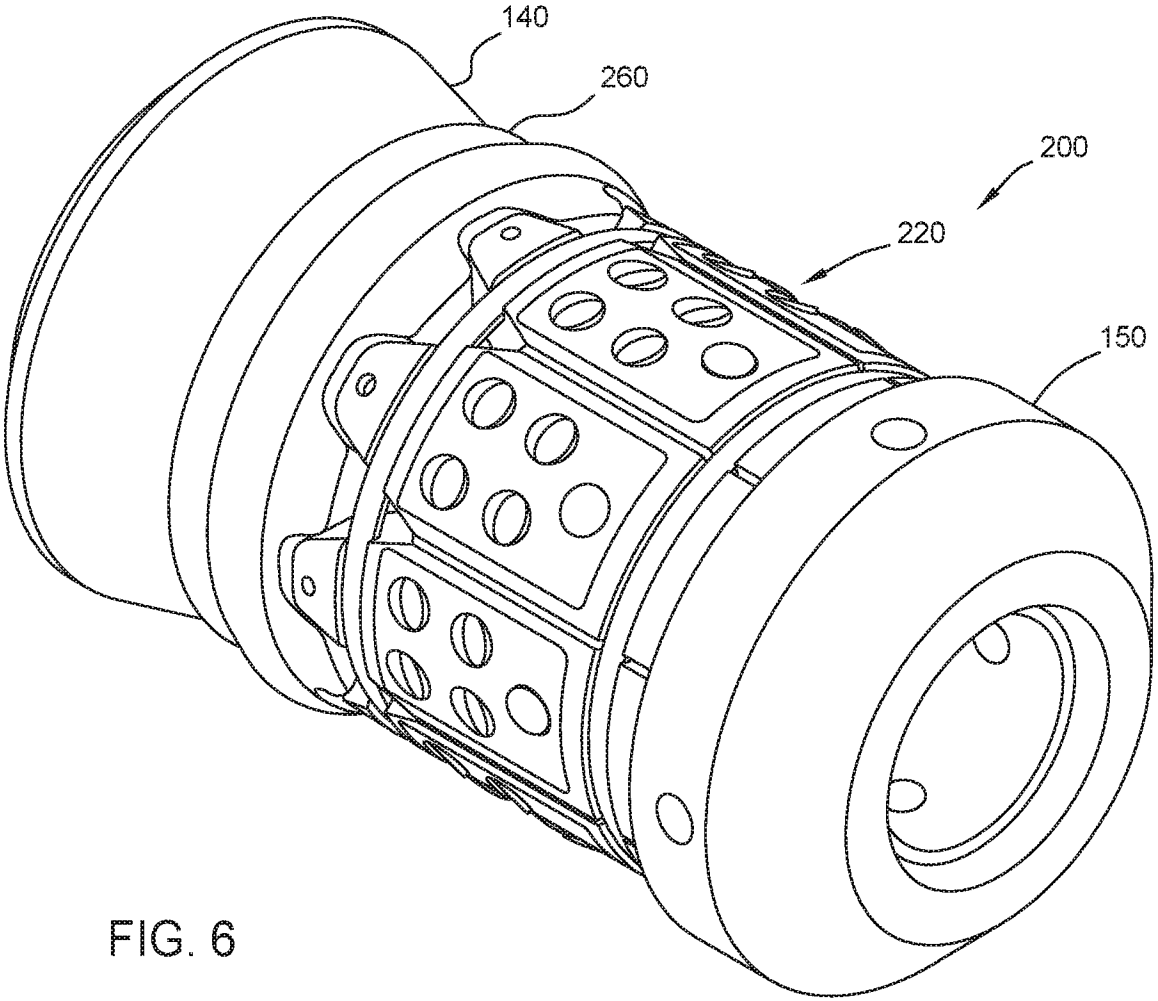
FIG. 6 is an enlarged perspective view of another embodiment of the downhole tool.
Figure 7:
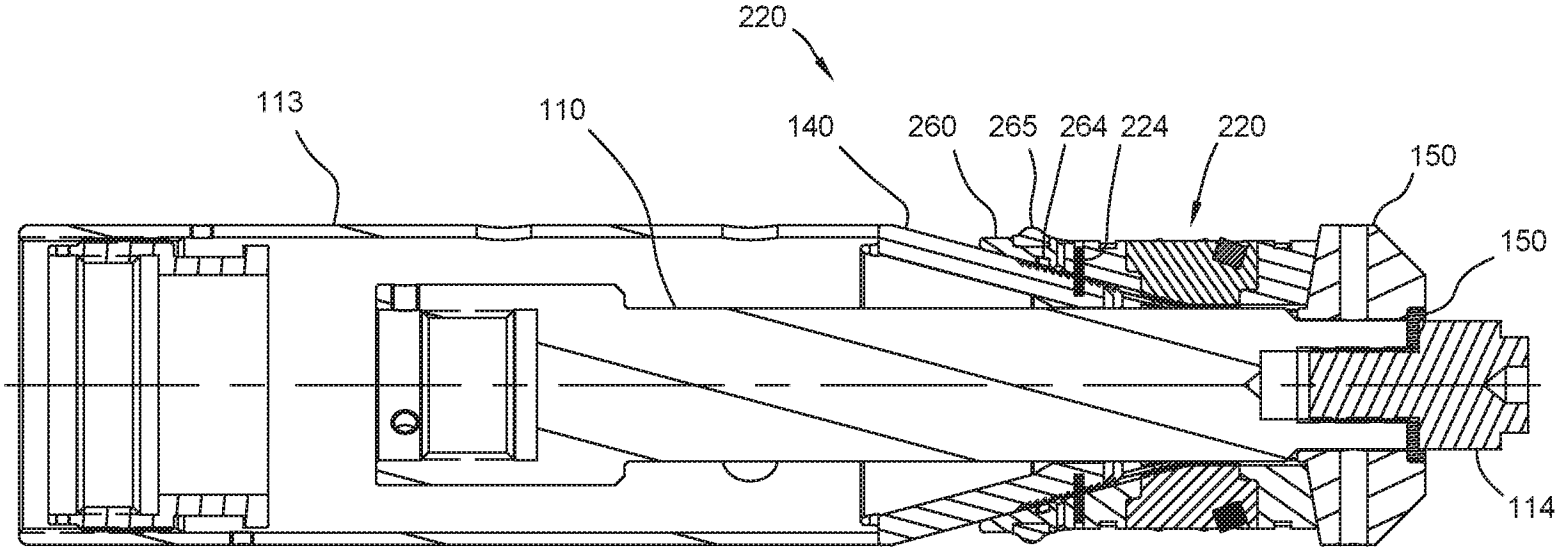
FIG. 7 is a cross-sectional view of the downhole tool of FIG. 6.
Figure 7A:
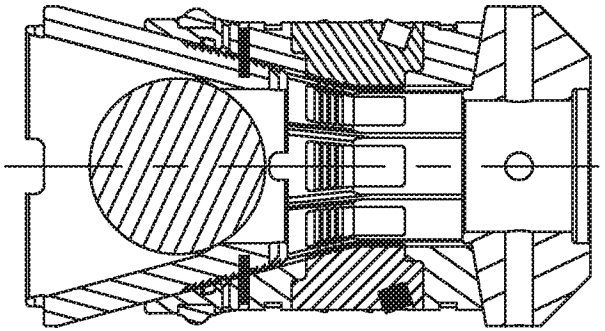

FIG. 6 is an enlarged perspective view of another embodiment of the downhole tool 200. FIG. 7 is a cross-sectional view of the downhole tool 200 of FIG. 6. The downhole tool 200 can be a bridge plug as shown, but it could also be a packer, a liner hanger, an anchoring device, or other downhole tool that uses a slip assembly to engage a downhole tubular, such as casing.

The tool 200 includes a cone 140, a slip assembly 220, a seal assembly 260, and an end ring 150 arranged on a mandrel 110. As shown, the slip assembly 220 is disposed between the cone 140 and the end ring 150. One end of the mandrel 110 is releasably attached to the end ring 150. For example, a shear ring 152 is used to releasably attach the mandrel 110 and the end ring 150. The shear ring 152 can be disposed between the mandrel 110 and a nut 114 coupled to the end of the mandrel 110. FIG. 7 shows the downhole tool 200 coupled to a setting sleeve 113 for activating the tool 200.

When deployed downhole, the tool 200 is activated by a wireline setting tool, which uses conventional techniques of pulling the mandrel 110 while simultaneously pulling the slip assembly 220 against the cone 140. As a result, the slip assembly 220 ride up the cone 220 and move outward to engage a wall of the surrounding casing. The slip assembly 220 retains the downhole tool 200 in place in the casing. The setting sleeve 113 and the mandrel 110 can be retrieved to surface.

In one embodiment, one or more components of the tool 200 are preferably composed of degradable materials so the tool 200 can be removed from the casing upon completion of operations without requiring a milled out operation. For example, at least one of the cone 140, the end ring 150, the slip assembly 220, and the seal assembly 260 can be manufactured from a degradable material. In one example, one or more components of the tool 200 are composed of a dissolvable material. An exemplary dissolvable material is a dissolvable polymeric material.

Referring back to FIG. 7, the cone 140 includes an inclined surface and is arranged on the mandrel 110 with its inclined surface facing the end ring 150. In this example, teeth are formed on the inclined surface for mating with the teeth of the sealing assembly 260 and the teeth of the slip assembly 220. In one embodiment, the cone 140 is made of a degradable polymer.

The slip assembly 220 is disposed between the cone 140 and the end ring 150. In one embodiment, the slip assembly 220 includes a plurality of slip segments 222 circumferentially disposed around the mandrel 110. In this example, the slip assembly 220 includes eight slip segments 222. However, any suitable number of slip segments 222 may be used. The plurality of slip segments 222 can be held together using one or more bands. In another embodiment, the slip assembly 220 is a unitary body.

Figure 8:
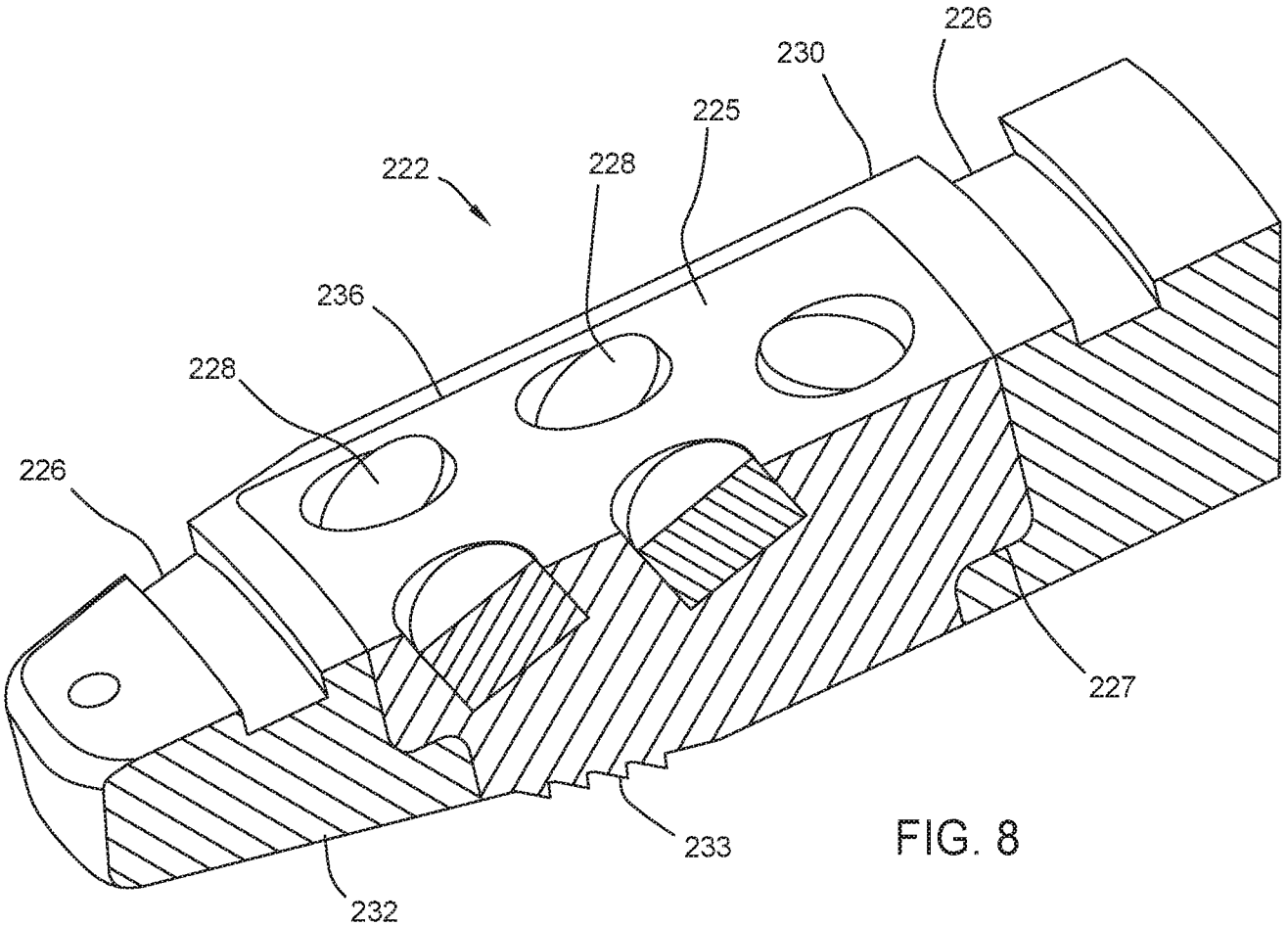
FIG. 8 is a cross-sectional view of an exemplary embodiment of a slip segment.

FIG. 8 is a cross-sectional view of an exemplary embodiment of a slip segment 222. The slip segment 222 includes a slip body 230, a slip insert 225, and a gripping element such as a button 228. The slip body 230 has an inclined surface 232 for riding on the inclined surface of the cone 140. Grooves 226 for bands 123 may be provided in the outer surface of the slip body 230 for retaining the slip segments 222 to the downhole tool 200. The end of the slip body 230 with the inclined surface has a wedge shape. During run-in, the slip segments 222 may be selectively attached to the cone 140 using a releasable connection, such as a shear pin 224, to prevent premature activation of the slip assembly 220.

In one embodiment, the slip body 230 is made of a dissolvable non-metallic material. Suitable dissolvable non-metallic materials include dissolvable non-metallic polylactic acid (PLA) based polymers, polyglycolic acid (PGA)

based polymers, degradable urethane, other polymers that are dissolvable over time. In one example, the slip body 230 is manufactured using an injection molding process. The dissolvable non-metallic material is injected into a mold of the shape of the slip body 230, where it is allowed to solidify before removal from the mold. The injection molding process advantageously provides for a lower cost slip assembly manufacturing process and for various designs of the slip assembly such as segmented or interconnected.

The slip insert 225 is disposed in a pocket 236 formed in the slip body 230. In this example, the pocket 236 is a hole that extends through the depth of the slip body 230. In one embodiment, the slip insert 225 is attached to the slip body 230 after the slip body 230 is removed from the injection mold. In one example, the slip insert 225 is attached to the slip body 230 using an adhesive such as glue. In another embodiment, the slip insert 225 is disposed in the mold before the slip body material is injected into the mold. In this respect, the slip insert 225 is attached to the slip body 230 as the slip body solidifies. In this example, the slip insert 225 includes one or more shoulders 237 for supporting the slip insert 225 in the pocket 236. Depending on its position in the slip body 230, the slip insert 225 may include an inclined surface for engaging the cone 140. In one example, the slip insert 225 optionally includes teeth 233 on the inclined surface for mating with the teeth of the cone 140.

In one embodiment, the slip insert 225 is made of a dissolvable metallic material. Suitable dissolvable metallic materials include magnesium or aluminum based dissolvable alloys. The dissolvable metallic materials are dissolvable upon contact with a solvent.

As discussed above, each slip insert 225 includes one or more gripping elements for gripping the casing. An exemplary gripping element is a slip button 228. In this example, a plurality of slip buttons 228 are embedded into the slip insert 225. In at least one aspect, a portion of the slip buttons 228 is recessed into a corresponding cavity formed in the outer surface of the slip body 230. At least a portion of the slip buttons 228 extends from the outer surface of the slip insert 225. Each of the slip buttons 228 typically has one or more sharp edges that protrude from the outer surface of the slip body 230. In one example, the buttons 228 have a cylindrical shape. However, the slip buttons 228 may take any form or shape. The buttons 228 can be installed at an angle relative to the radius of the slip assembly 220 such that a portion of the upper surface extends out of the upper surface of the slip insert 225. In one example, the buttons 228 can have different angles relative to the radius. The slip buttons 228 may be made of any material that will penetrate the casing. For example, the slip buttons 228 made be made of machined ductile iron, cast iron, powder metal, ceramic, or combinations thereof. The slip insert 225 can include any number of buttons 228 and any suitable arrangements.

Figure 9:
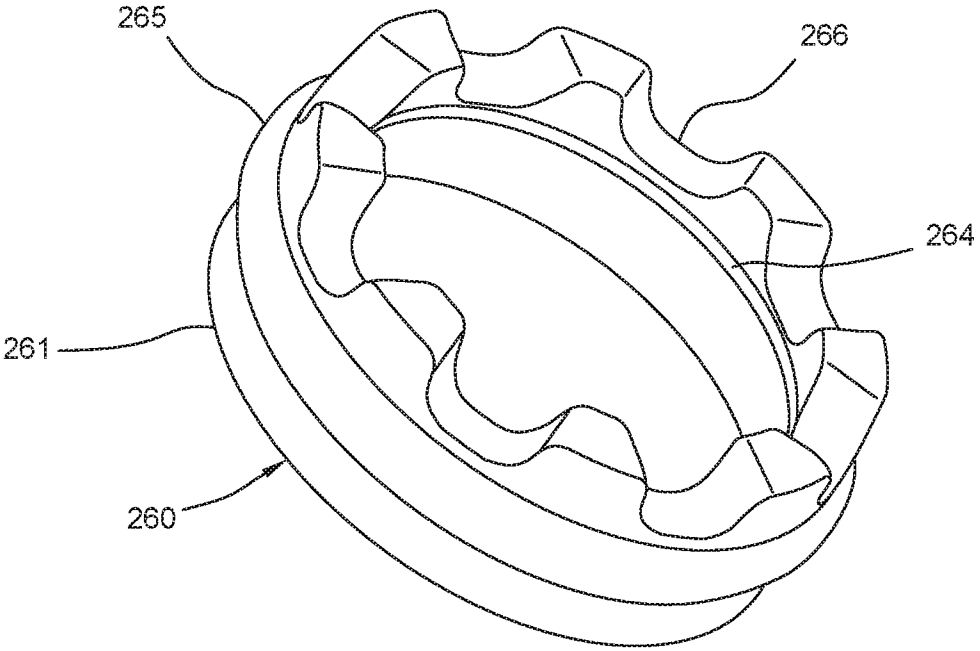
FIG. 9 is a cross-sectional view of an exemplary embodiment of a seal assembly.

The seal assembly 260 is disposed on the cone 140 adjacent the slip assembly 220. In one embodiment, the seal assembly 260 has a circular seal body 261, as shown in FIG. 9. Referring to FIGS. 7 and 9, the seal body 261 includes an inclined surface for riding on the inclined surface of the cone 140. The end of the seal body 261 adjacent the slip segments 222 has wedge shaped recesses 266 for accommodating the wedge shaped ends of the slip segments 222. In one embodiment, a sealing element, such as a seal ring 265, is disposed on an outer surface of the seal assembly 260. The seal ring 265 is configured to sealingly engage the casing wall when the seal assembly 260 is urged outward by the cone 140. The seal ring 265 may sit in a groove formed in the outer surface of the seal body 261. In one embodiment, the seal assembly 260 may be selectively attached to the cone 140 using a releasable connection, such as a snap ring 264, to prevent premature activation of the seal assembly 260.

In one embodiment, the seal assembly 260 is made of a dissolvable non-metallic material. Suitable dissolvable non-metallic materials include dissolvable non-metallic polylactic acid (PLA) based polymers, polyglycolic acid (PGA) based polymers, degradable urethane, other polymers that are dissolvable over time. In one example, the seal assembly 260 is manufactured using an injection molding process. The dissolvable non-metallic material is injected into a mold of the shape of the seal assembly 260, where it is allowed to solidify before removal from the mold. The injection molding process advantageously provides for a lower cost manufacturing process and for various designs of the seal assembly such as segmented, interconnected, and unitary body.

When deployed downhole, the tool 200 is activated by a wireline setting tool, which uses conventional techniques of pulling the mandrel 110 while simultaneously pulling the slip assembly 220 against the cone 140. The cone 140 is axially abutted against the setting sleeve 113. As a result, the slip assembly 220 ride up the cone 140 and move outward to engage a wall of the surrounding casing. In this manner, the slip assembly 220 retains the downhole tool 200 in place in the casing. The slip assembly 220 also causes the seal assembly 260 to move up the inclined surface of the cone 140. The seal ring 265 of the seal assembly 260 sealingly engages the casing wall to close fluid communication therebetween. Thereafter, the setting sleeve 113 and the mandrel 110 can be retrieved to surface.

To begin the fracturing operation, a ball is released into the casing and lands in a seat of the downhole tool 200. Fracturing fluid is pumped into the casing to fracture the formation upstream from the downhole tool 200. After pumping the fracturing fluid, the downhole tool 100 may degrade over time, thereby eliminating the need for a drilling operation to remove the downhole tool 200.

Figure 10:
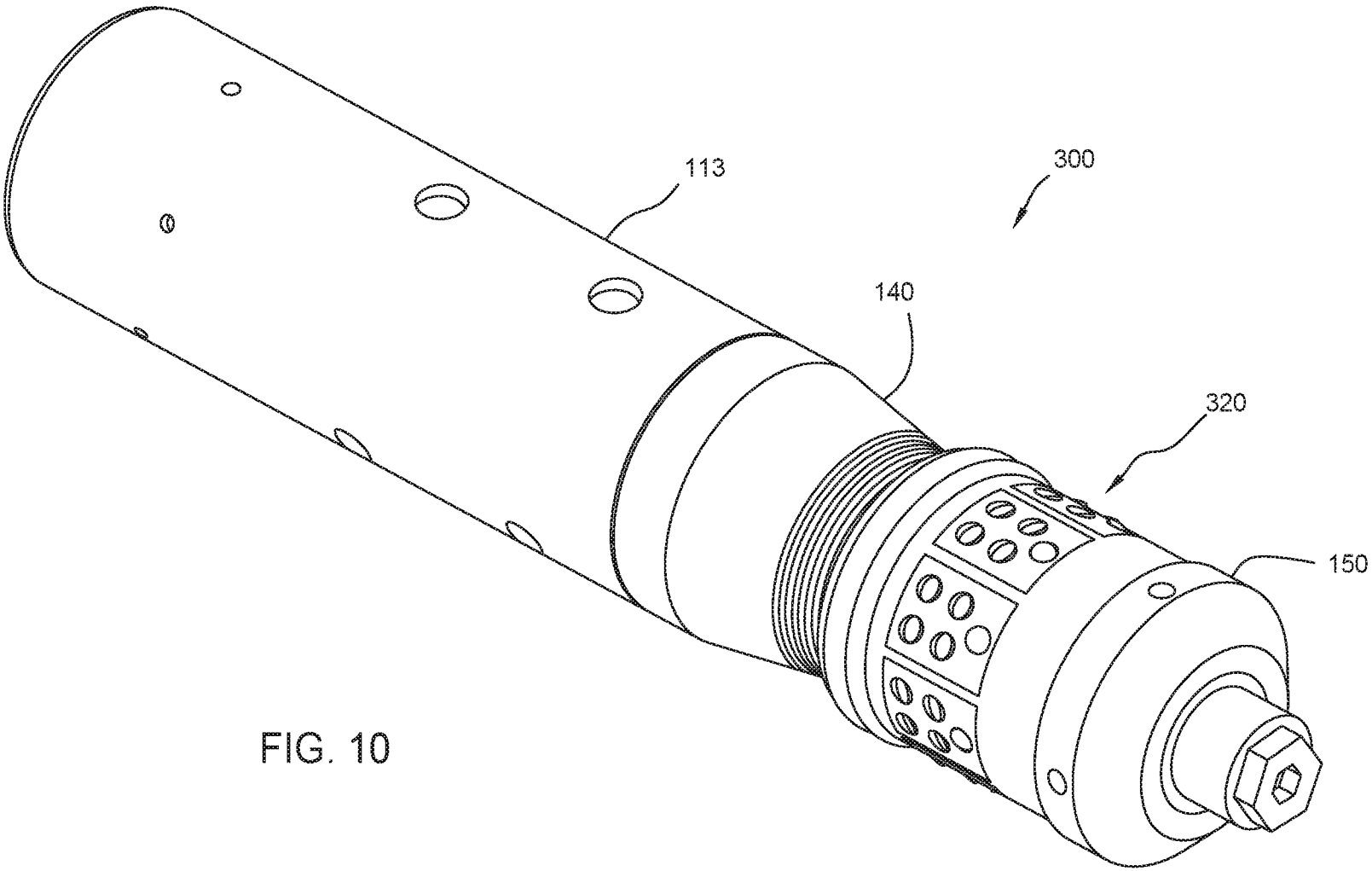
FIG. 10 is a perspective view of a downhole tool according to an embodiment of the present disclosure.
Figure 11:
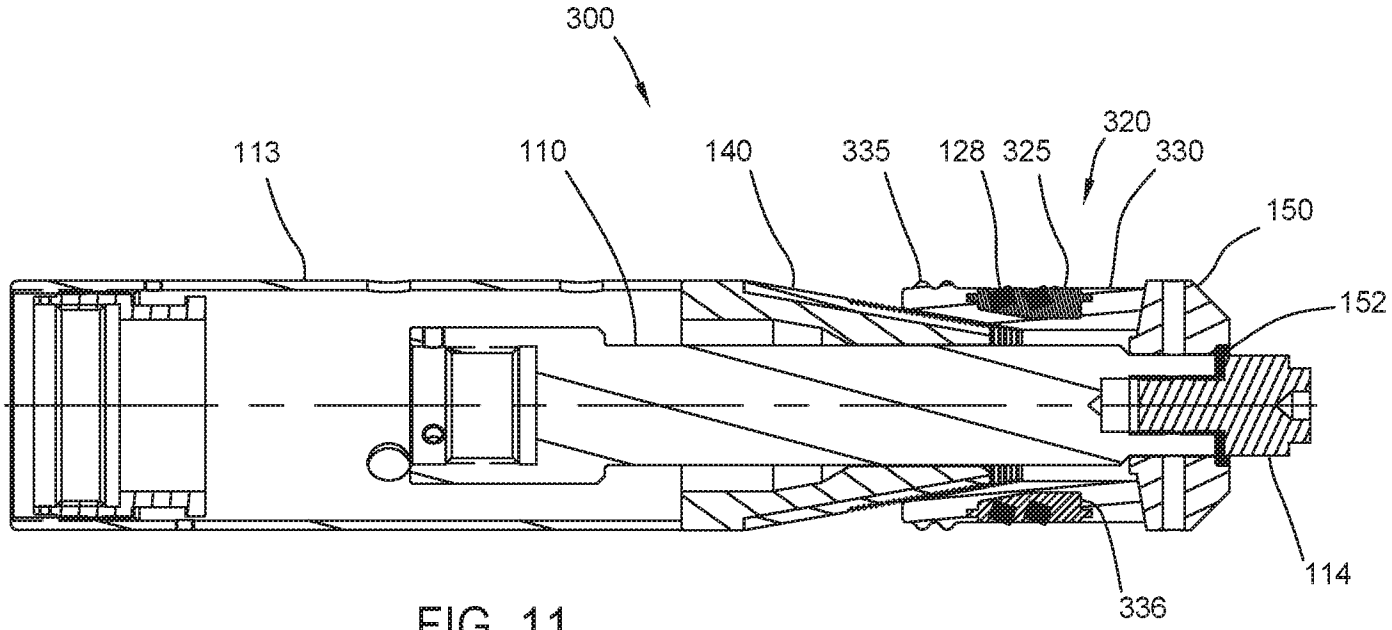
FIG. 11 is a cross-sectional view of the downhole tool of FIG. 10.
Figure 11A:
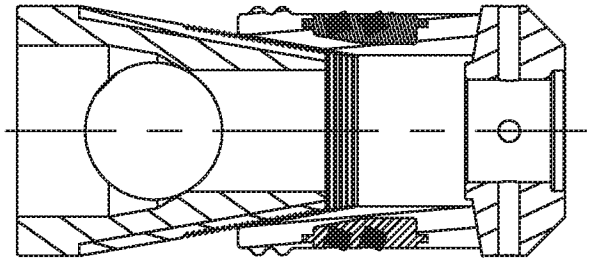

FIG. 10 is a perspective view of a downhole tool 300 according to an embodiment of the present disclosure. FIG. 11 is a cross-sectional view of the downhole tool 300 of FIG. 10. The downhole tool 300 can be a bridge plug as shown, but it could also be a packer, a liner hanger, an anchoring device, or other downhole tool that uses a slip assembly to engage a downhole tubular, such as casing.

The tool 300 includes a cone 140, a slip assembly 320, and an end ring 150 arranged on a mandrel 110. As shown, the slip assembly 320 is disposed between the cone 140 and the end ring 150. One end of the mandrel 110 is releasably attached to the end ring 150. For example, a shear ring 152 is used to releasably attach the mandrel 110 and the end ring 150. The shear ring 152 can be disposed between the mandrel 110 and a nut 114 coupled to the end of the mandrel 110. FIGS. 10 and 11 show the downhole tool 300 coupled to a setting sleeve 113 for activating the tool 300.

In one embodiment, one or more components of the tool 300 are preferably composed of degradable materials so the tool 300 can be removed from the casing upon completion of operations without requiring a milled out operation. For example, at least one of the cone 140, the end ring 150, and the slip assembly 320 can be manufactured from a degradable material. In one example, one or more components of the tool 300 are composed of a dissolvable material. An exemplary dissolvable material is a dissolvable polymeric material.

As shown, the cone 140 includes an inclined surface and is arranged on the mandrel 110 with its inclined surface facing the end ring 150. In this example, teeth are formed on the inclined surface for mating with the teeth of the slip assembly 320. In one embodiment, the cone 140 is made of a degradable polymer.

Figure 10A:
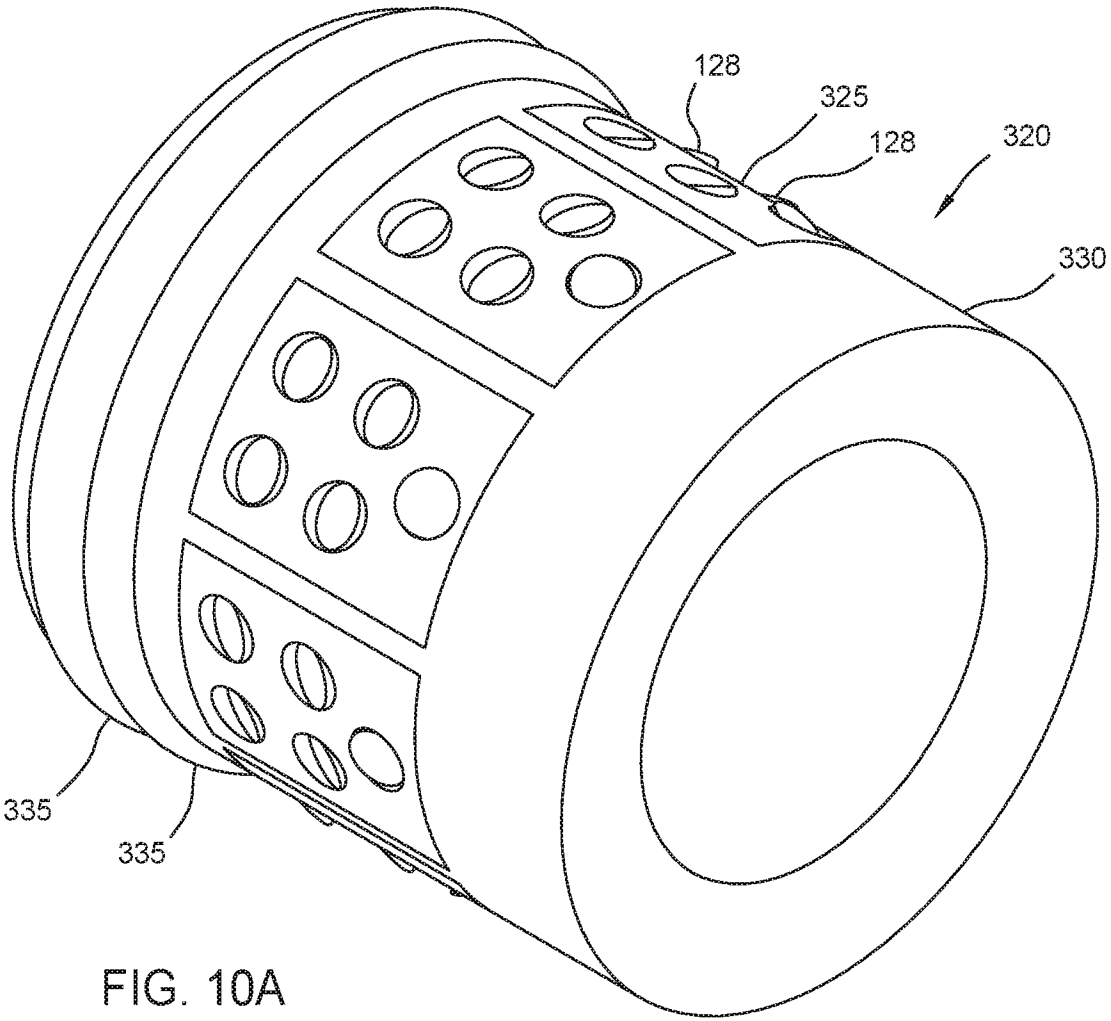
FIG. 10A is an enlarged perspective view of the slip assembly of FIG. 10.
Figure 10B:
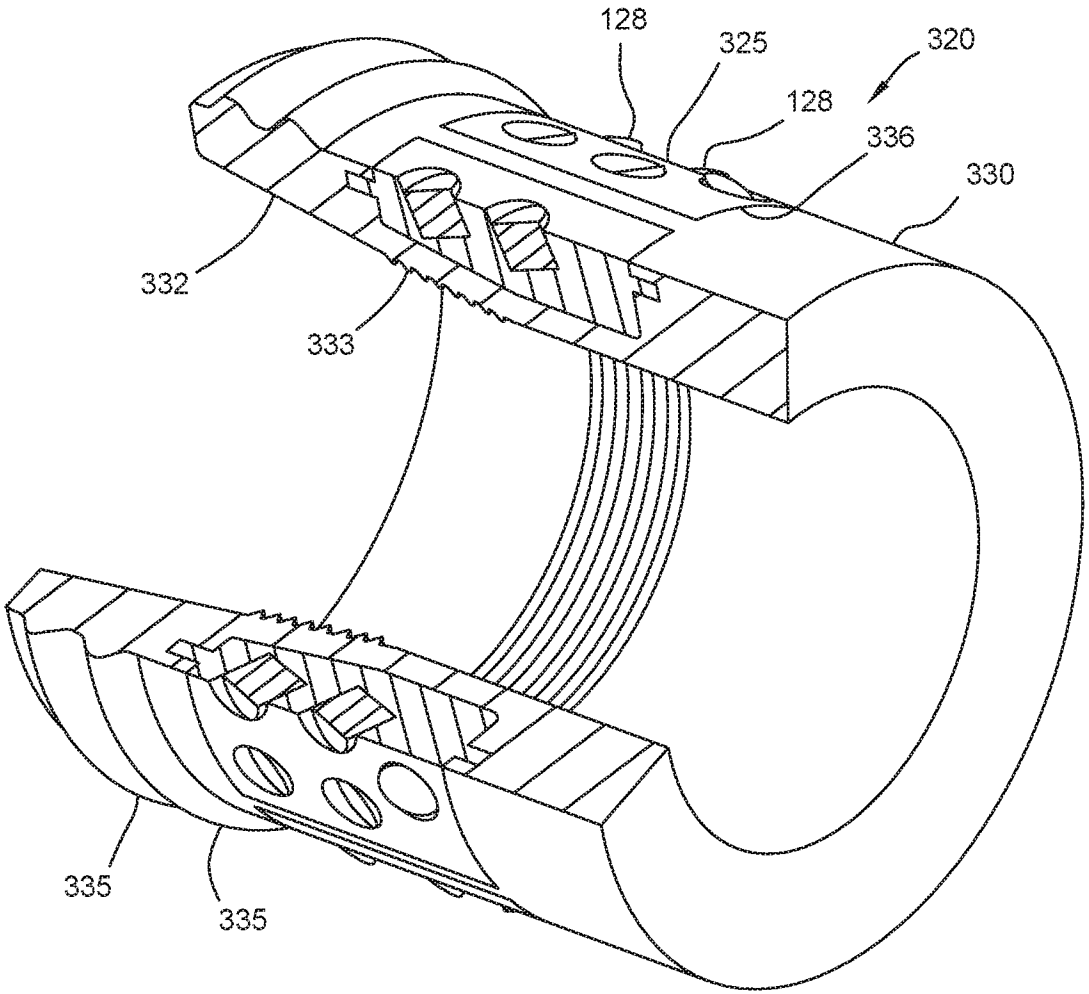
FIG. 10B is an enlarged, partial cross-sectional view of the slip assembly of FIG. 10A.

FIG. 10A is an enlarged perspective view of the slip assembly 320. FIG. 10B is an enlarged, partial cross-sectional view of the slip assembly 320. The slip assembly 320 is disposed between the cone 140 and the end ring 150. In this embodiment, the slip assembly 320 includes a unitary slip body 330, one or more slip inserts 325, and one ore more gripping elements such as buttons 128. The slip body 330 is tubular shaped and is disposed around the cone 140 and the mandrel 110. The slip body 330 has an inclined surface 332 for riding on the inclined surface of the cone 140. Teeth 333 may be provided on the inclined surface 332 for mating with the teeth of the cone 140. One or more sealing members are provided on the outer surface of the slip body 330. In this example, the sealing members are sealing protrusions 335 formed integrally with the slip body 330. The sealing protrusions 335 are configured to sealingly engage the casing wall when the slip assembly 320 is urged outward by the cone 140. While two protrusions 335 are shown, any suitable number of protrusions may be provided, such as one, three, or more protrusions.

Figure 12:
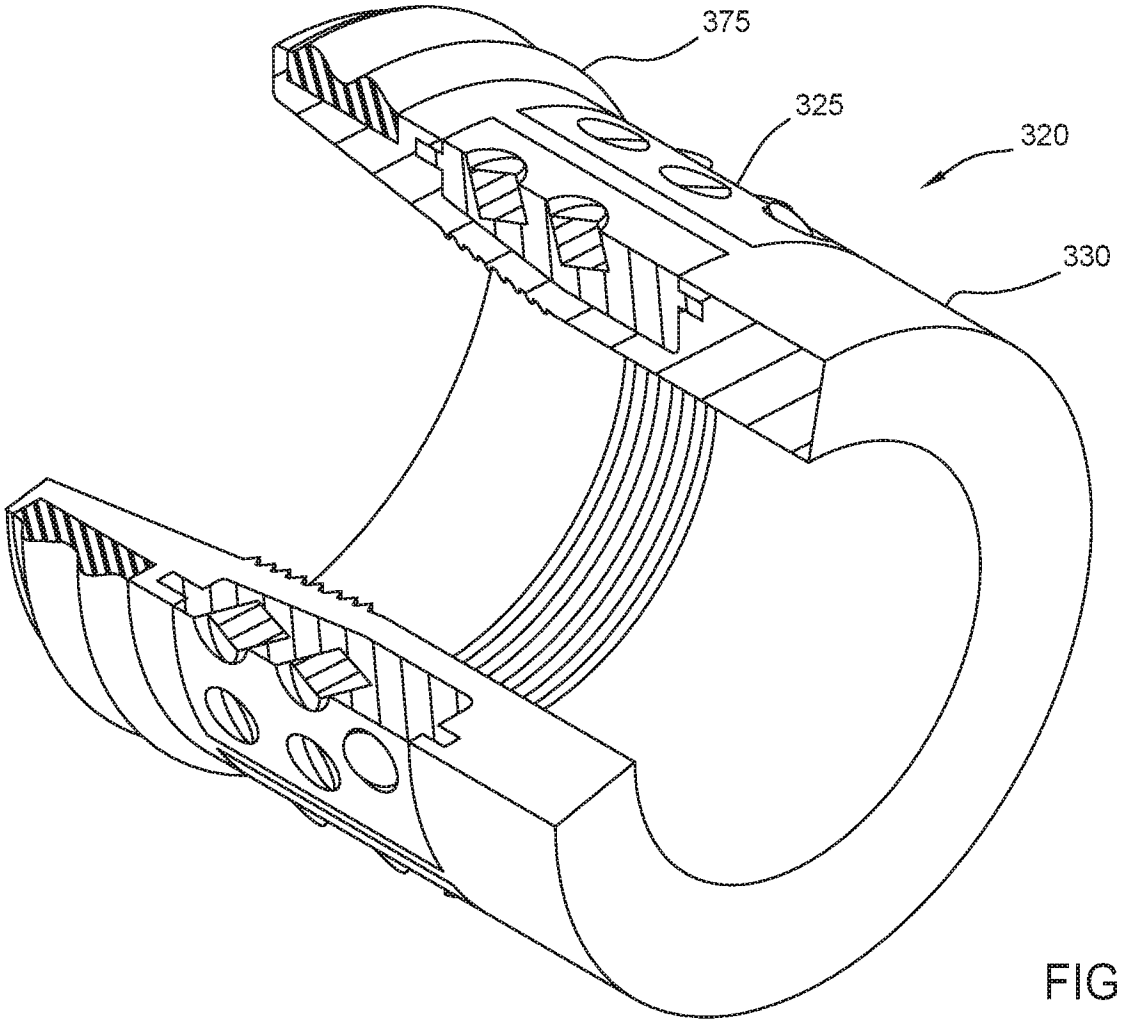
FIG. 12 is a perspective view of an embodiment of slip assembly equipped with a sealing ring.

In another example, the sealing member is a sealing ring 375 attached to the slip body 330, as shown in FIG. 12. The sealing ring 375 may be disposed in a groove formed in the slip body 330. The sealing ring 375 is configured to sealingly engage the casing wall when the slip assembly 320 is urged outward by the cone 140.

In one embodiment, the slip body 330 is made of a dissolvable non-metallic material. Suitable dissolvable non-metallic materials include dissolvable non-metallic polylactic acid (PLA) based polymers, polyglycolic acid (PGA) based polymers, degradable urethane, other polymers that are dissolvable over time. In one example, the slip body 330 is manufactured using an injection molding process. The dissolvable non-metallic material is injected into a mold of the shape of the slip body 330, where it is allowed to solidify before removal from the mold. The injection molding process advantageously provides for a lower cost slip assembly manufacturing process and for various designs of the slip assembly such as segmented, interconnected, or unitary body. In one embodiment, the sealing ring 375 may be made of the same or different non-metallic polymeric material as the slip body 330.

The slip assembly 320 includes a plurality of slip inserts 325. Each slip insert 325 is disposed in a pocket 336 formed in the slip body 330. In one embodiment, the slips inserts 325 are circumferentially disposed in the pockets 336 around the slip body 330. In this example, the slip assembly 320 includes eight slip inserts 325. However, any suitable number of slip inserts may be used, such as three, four, five, six, seven, ten, or more slip inserts. In one embodiment, the slip inserts 325 are attached to the slip body 330 after the slip body 330 is removed from the injection mold. In another embodiment, the slip inserts 325 are disposed in the mold before the slip body material is injected into the mold. In this respect, the slip inserts 325 are attached to the slip body 330 as the slip body solidifies. In one example, the slip inserts 325 include one or more tongues that are engageable with a slot formed in the slip body 330. The tongues facilitate attachment of the slip insert 325 to the slip body.

Figure 13:
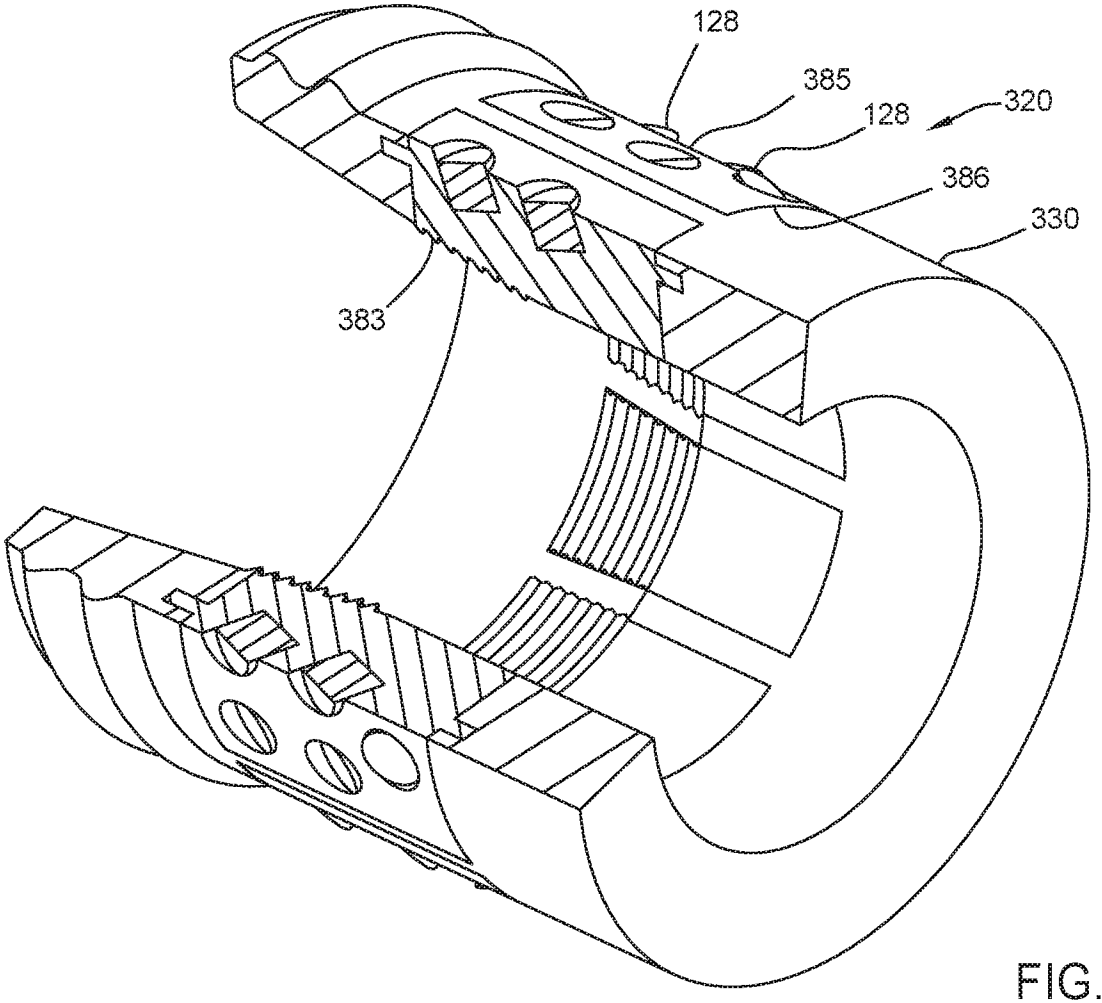
FIG. 13 is a perspective view of an embodiment of slip assembly equipped a slip insert.

In another embodiment, the pocket 386 is a hole, and the slip insert 385 extends through the depth of the slip body 330, as shown in FIG. 13. In one embodiment, the slip insert 385 is attached to the slip body 330 after the slip body 330 is removed from the injection mold. In one example, the slip insert 385 is attached to the slip body 330 using an adhesive such as glue. In another embodiment, the slip insert 385 is disposed in the mold before the slip body material is injected into the mold. In this respect, the slip insert 385 is attached to the slip body 330 as the slip body solidifies. In this example, the slip insert 385 includes one or more shoulders for supporting the slip insert 385 in the pocket 386. Depending on its position in the slip body 330, the slip insert 385 may include an inclined surface for engaging the cone 140. In one example, the slip insert 385 optionally includes teeth 383 on the inclined surface for mating with the teeth of the cone 140.

In one embodiment, the slip insert 325, 385 is made of a dissolvable metallic material. Suitable dissolvable metallic materials include magnesium or aluminum based dissolvable alloys. The dissolvable metallic materials are dissolvable upon contact with a solvent.

As discussed above, each slip insert 325, 385 includes one or more gripping elements for gripping the casing. An exemplary gripping element is a slip button 128. In this example, a plurality of slip buttons 128 are embedded into the slip insert 325. In at least one aspect, a portion of the slip buttons 128 is recessed into a corresponding cavity formed in the outer surface of the slip body 330. At least a portion of the slip buttons 128 extends from the outer surface of the slip insert 325. Each of the slip buttons 128 typically has one or more sharp edges that protrude from the outer surface of the slip body 330. In one example, the buttons 128 have a cylindrical shape. However, the slip buttons 128 may take any form or shape. The buttons 128 can be installed at an angle relative to the radius of the slip assembly 320 such that a portion of the upper surface extends out of the upper surface of the slip insert 325. In one example, the buttons 128 can have different angles relative to the radius. The slip buttons 128 may be made of any material that will penetrate the casing. For example, the slip buttons 228 made be made of machined ductile iron, cast iron, powder metal, ceramic, or combinations thereof. The slip insert 225 can include any number of buttons 228 and any suitable arrangements.

Figure 14:
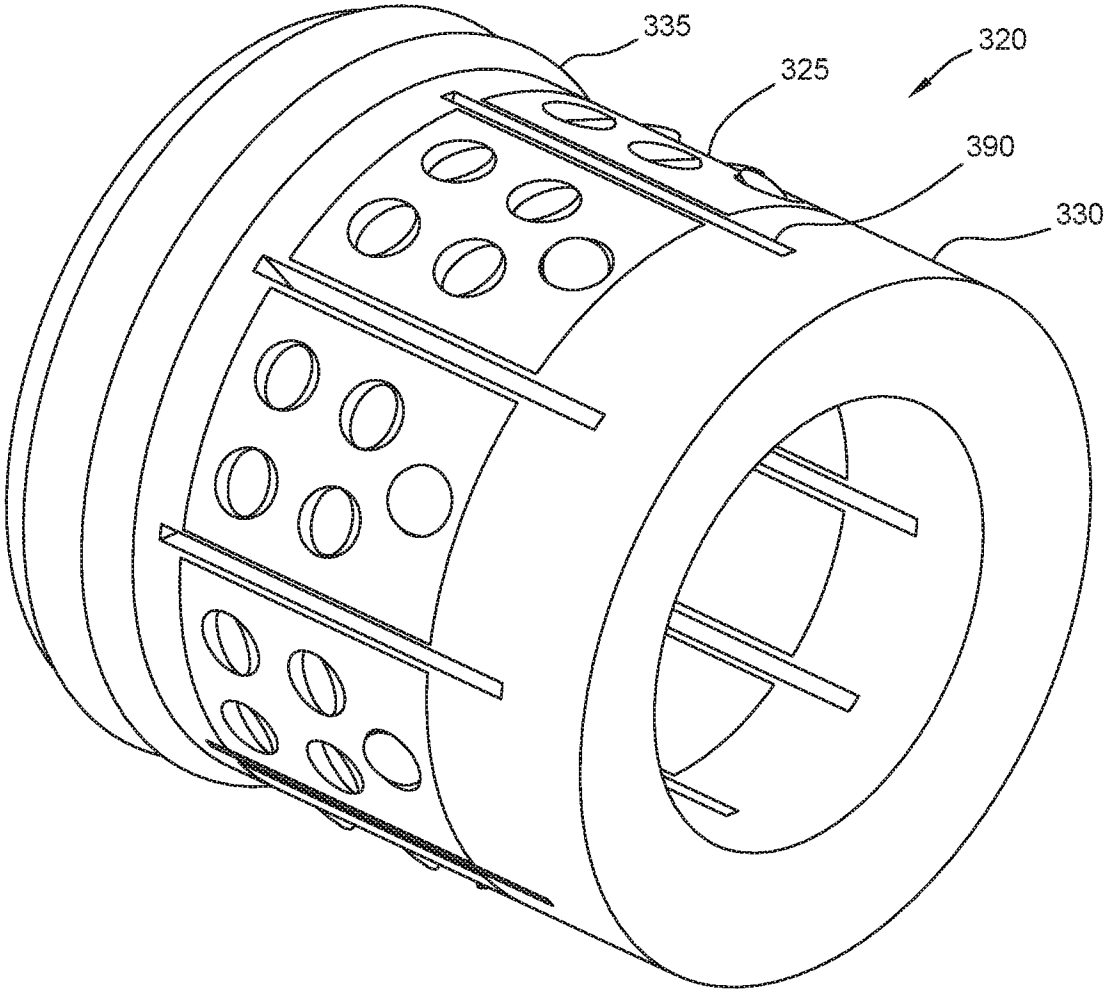
FIG. 14 is a perspective view of an embodiment of slip assembly equipped a slot.

In another embodiment, the slip body 330 can includes one or more slots 390 to reduce the expansion force needed to move the slip assembly 320 up the cone 140. As shown in FIG. 14, a slot 390 is formed between each adjacent slip inserts 325. In this example, the slots 390 are formed through the depth of the slip body 330. In another example, the slots 390 are recesses formed in the outer surface of the slip body 330. While eight slots 390 are shown, any suitable number of slots 390, such as two, four, or six slots, may be provided.

When deployed downhole, the tool 300 is activated by a wireline setting tool, which uses conventional techniques of pulling the mandrel 110 while simultaneously pulling the slip assembly 320 against the cone 140. The cone 140 is axially abutted against the setting sleeve 113. As a result, the slip assembly 320 ride up the cone 140 and move outward to engage a wall of the surrounding casing. In this manner, the slip assembly 320 retains the downhole tool 300 in place in the casing. The slip assembly 320 also causes the seal member 335, 375 to sealingly engage the casing. Thereafter, the setting sleeve 113 and the mandrel 110 can be retrieved to surface.

To begin the fracturing operation, a ball is released into the casing and lands in a seat of the downhole tool 300. Fracturing fluid is pumped into the casing to fracture the formation upstream from the downhole tool 300. After pumping the fracturing fluid, the downhole tool 300 may degrade over time, thereby eliminating the need for a drilling operation to remove the downhole tool 300.

In one embodiment, a downhole tool for engaging a downhole tubular includes a slip assembly. The slip assembly may include a slip body; a slip insert disposed in the slip body, the slip insert comprising a dissolvable metal alloy; and a plurality of gripping elements coupled to the slip insert, the gripping element configured to engage the downhole tubular.

In another embodiment, a downhole tool for engaging a downhole tubular includes a cone having an inclined surface and a slip assembly configured to ride along the inclined surface. The slip assembly may include an injection molded slip body; a slip insert disposed in the slip body, the slip insert comprising a dissolvable metal alloy; and a plurality of gripping elements coupled to the slip insert, the gripping element configured to engage the downhole tubular.

In one or more embodiments described herein, the slip body is formed using an injection molded process.

In one or more embodiments described herein, the slip insert includes a plurality of cavities for housing a respective gripping element.

In one or more embodiments described herein, the plurality of gripping elements comprise a plurality of buttons.

In one or more embodiments described herein, the slip insert is disposed in a pocket of the slip body.

In one or more embodiments described herein, the pocket extends through a depth of the slip body.

In one or more embodiments described herein, the slip insert includes teeth formed on an interior surface.

In one or more embodiments described herein, the slip assembly includes a plurality of slip segments and wherein each of the slip segments includes a slip body.

In one or more embodiments described herein, the tool includes a band for retaining the plurality of slip segments.

In one or more embodiments described herein, the slip body comprises a unitary tubular body.

In one or more embodiments described herein, slip assembly includes a slot formed in the slip body.

In one or more embodiments described herein, the tool includes a sealing member configured to engage the downhole tubular.

In one or more embodiments described herein, the sealing member comprises a sealing ring disposed on an outer surface of the slip body.

In one or more embodiments described herein, the sealing member comprises a protrusion formed on an outer surface of the slip body.

In one or more embodiments described herein, the protrusion is formed on a slip body of the slip segment.

In one or more embodiments described herein, the tool includes a seal assembly having a plurality of seal segments.

In one or more embodiments described herein, a protrusion formed on the plurality of seal segments is configured to form a sealing ring with the protrusion of the slip segment.

While the foregoing is directed to embodiments of the present disclosure, other and further embodiments of the disclosure may be devised without departing from the basic scope thereof, and the scope thereof is determined by the claims that follow.

The invention claimed is:

1. A downhole tool for engaging a downhole tubular, comprising:

a slip assembly having:

a slip body;

a slip insert disposed in a pocket of the slip body, the slip insert comprising a dissolvable metal alloy; and a plurality of gripping elements disposed in a respective cavity of the slip insert, the gripping element configured to engage the downhole tubular.

2. The tool of claim 1, wherein the slip body is formed using an injection molded process.

3. The tool of claim 2, wherein the slip body comprises a unitary tubular body.

4. The tool of claim 3, further comprising a slot formed in the slip body.

5. The tool of claim 2, further comprising a sealing member configured to engage the downhole tubular.

6. The tool of claim 5, wherein the sealing member comprises a sealing ring disposed on an outer surface of the slip body.

7. The tool of claim 5, wherein the sealing member comprises a protrusion formed on an outer surface of the slip body.

8. The tool of claim 7, wherein the slip assembly includes a plurality of slip segments and wherein each of the slip segments includes the slip body.

9. The tool of claim 8, further comprising a seal assembly having a plurality of seal segments.

10. The tool of claim 9, wherein the protrusion formed on the plurality of seal segments is configured to form a sealing ring with the protrusion of the slip segment.

11. The tool of claim 1, wherein the plurality of gripping elements comprise a plurality of buttons.

12. The tool of claim 1, wherein the pocket extends through a depth of the slip body.

13. The tool of claim 1, wherein the slip insert includes teeth formed on an interior surface.

14. The tool of claim 2, wherein the slip assembly includes a plurality of slip segments and wherein each of the slip segments includes the slip body.

15. The tool of claim 14, further comprising a band for retaining the plurality of slip segments.

16. A downhole tool for engaging a downhole tubular, comprising:

a cone having an inclined surface;

a slip assembly configured to ride along the inclined surface, the slip assembly having:

an injection molded slip body comprising a dissolvable polymer;

a slip insert disposed in the slip body, the slip insert comprising a dissolvable metal alloy; and a plurality of gripping elements coupled to the slip insert, the gripping elements configured to engage the downhole tubular.

17. The tool of claim 16, wherein the slip insert includes a plurality of cavities for housing a respective gripping element.

18. The tool of claim 17, wherein the slip insert is disposed in a pocket of the slip body.

19. A downhole tool for engaging a downhole tubular, comprising:

a slip assembly having a plurality of slip segments, each slip segment including:

a slip body;

a slip insert disposed in the slip body, the slip insert comprising a dissolvable metal alloy;

a plurality of gripping elements coupled to the slip insert, the gripping element configured to engage the downhole tubular; and a protrusion formed on an outer surface of the slip body; and a seal assembly having a plurality of seal segments.

20. The tool of claim 19, wherein a protrusion formed on the plurality of seal segments is configured to form a sealing ring with the protrusion of the slip segment.

* * * * *